United States Patent [19]

Sawada et al.

[11] 4,219,707

[45] Aug. 26, 1980

[54] DISTRIBUTOR WITH COATED ALKALINE EARTH OXIDE ELECTRODE

[75] Inventors: Hiroji Sawada, Hitachi; Tatsuo Igawa, Kitaibaraki, both of Japan

[73] Assignees: Hitachi, Ltd.; Nissan Motor Co., Ltd., both of Japan

[21] Appl. No.: 964,817

[22] Filed: Nov. 30, 1978

[30] Foreign Application Priority Data

Nov. 30, 1977 [JP] Japan ..... 52-142767

[51] Int. Cl.[2] ..... H01H 19/00; H01H 1/00

[52] U.S. Cl. ..... 200/19 R; 123/633; 200/19 DC; 200/19 DR; 200/267

[58] Field of Search ..... 200/19 R, 19 DC, 19 DR, 200/262, 264, 266, 267; 123/148 P, 146.5 A; 251/521; 75/200, 206, 232, 235, 248, 249

[56] References Cited

U.S. PATENT DOCUMENTS

| | | | |
|---|---|---|---|
| 2,396,101 | 3/1946 | Hensel et al. | 75/235 |
| 2,830,027 | 4/1958 | Schweitzer | 252/521 |
| 4,007,342 | 2/1977 | Makino et al. | 200/19 R |

*Primary Examiner*—James R. Scott

*Attorney, Agent, or Firm*—Craig and Antonelli

[57] ABSTRACT

A distributor for distributing a high voltage from an ignition system of an internal combustion engine to sparking plugs arranged so as to oppose to the rotating electrode through very small gaps is improved by the provision of a filmy layer made of an oxide of an alkaline-earth metal which is formed on the discharge portion of the rotating electrode or the surface of each of the fixed electrodes.

3 Claims, 4 Drawing Figures

DISTRIBUTOR WITH COATED ALKALINE EARTH OXIDE ELECTRODE

BACKGROUND OF THE INVENTION

This invention relates to a distributor for an electric spark ignitor in an internal combustion engine. More particularly, it relates to an improved rotating electrode of the distributor, by which the field intensity of noise to be radiated at a discharge is reduced.

Noise electric waves which are generated by discharges in the ignition device of an internal combustion engine such as automobile engine, especially in a distributor, have frequency components over a wide range likewise to noise electric waves which are generated by the discharge of an ignition plug. They also extend over a wide range spatially, and exert evil effects on television and radio sets in the surroundings besides electronic circuits within an automobile.

In order to reduce such noise electric waves, various systems and methods have heretofore been devised and put into practical use. It has been known that the use of an ignition plug with a resistor or a high tension cable made up of a high resistance wire of carbon is very effective for reducing the generation of the noise electric waves in the ignition plug. On the other hand, as regards the noise electric waves which are generated from the distributor, various devices and systems have been proposed, but any means exhibiting a satisfactory effect has not been obtained yet.

For example, Japanese Pat. Publication No. 51-38852 discloses a distributor having a rotating electrode whose discharge electrode portion is coated with a high resistance substance layer made of copper oxide, aluminum oxide, silicon oxide, nickel oxide, an oxide of a nickel-aluminum alloy, or the like.

Japanese Pat. Publication No. 51-38853 discloses a distributor having a rotating electrode whose discharge electrode portion is coated with a high resistance substance layer made of silicon oxide, aluminum oxide, an oxide of an iron-nickel alloy, or the like.

Even the distributors of such constructions, however, have low suppressive effects for noise electric wave components of and above 300 MHz.

SUMMARY OF THE INVENTION

An object of this invention is to provide a distributor which can suppress noise electric waves over a wide frequency range.

The above-mentioned object is accomplished in such a way that a deposited layer made of at least one of oxides of alkaline-earth metals is formed on a discharge electrode portion of a rotating electrode buried in a rotor of a distributor or/and a plurality of fixed electrodes arranged so as to oppose to the rotating electrode through a very small gap.

DETAILED DESCRIPTION OF THE PREFERRED EMBODIMENTS

In a distributor, it is very effective for the reduction of noise electric waves to suppress to be low a capacitive discharge current which flows through a very small gap between a rotating electrode and a fixed electrode. To this end, it is necessary to make the discharge voltage of the very small gap low. The inventors conducted various experiments and studied on a large number of materials. As a result, it has been found out that it is effective for the lowering of the discharge voltage and the reduction of the noise to form a deposited layer of an oxide of an alkaline-earth metal on a discharge portion, i.e., a fore end part of the rotating electrode or the fixed electrode.

Figure 1:
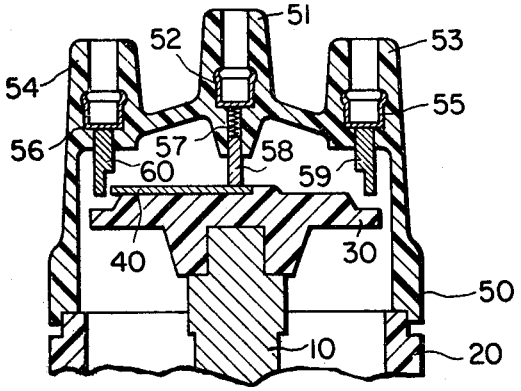
FIG. 1 shows a section of a distributor according to this invention.

Referring to FIG. 1, a rotary shaft 10 is rotatably mounted on the axis of a cylindrical metallic housing 20. The rotary shaft 10 is mechanically coupled with a crank shaft of an engine. A rotor 30 is secured to the upper end part of the rotary shaft 10, and it rotates in synchronism with the rotation of the engine. A rotating electrode 40 is secured onto the surface of the rotor 30. A cap 50 formed of a resin is disposed over the metallic housing 20 in a manner to surround the rotary shaft 10 and the rotor 30. A hollow protrusion 51 is formed outwards on the axis of the cap 50, and a central terminal 52 is disposed inside the hollow protrusion 51. Further, on the surface of the upper end part of the cap 50, a plurality of hollow protrusions corresponding to the number of cylinders of the engine are disposed radiately about the central protrusion 51. As shown in the figure, terminals are disposed in the respective peripheral protrusions as in the central protrusion 51. Among the peripheral terminals disposed in the peripheral protrusions, those disposed in the peripheral protrusions 53 and 54 are indicated by reference numerals 55 and 56 respectively. The central terminal 52 is electrically connected with a contact terminal 58 made of a carbon rod through a spring 57. The spring 57 also urges the contact terminal 58 against the rotating electrode 40 secured on the surface of the rotor 30, so that the central terminal 52 and the rotating electrode 40 are electrically connected. On the other hand, the peripheral terminals have fixed electrodes respectively. Among the fixed electrodes, those of the peripheral terminals 55 and 56 are indicated by reference numerals 59 and 60 respectively. The fixed electrodes are radiately located at equal angular intervals about the rotational axis of the rotor 30. Therefore, as the engine rotates, the rotor 30 rotates, and the discharge tip part of the rotating electrode 40 approaches the respective fixed electrodes periodically. By the approach, a very small gap is formed between the tip part of the rotating electrode 40 and the fixed electrode.

A secondary high voltage which is induced in response to the sudden cutoff of a primary current in an ignition coil is led to the rotating electrode 40 on the rotor 30 through the central terminal 52, the spring 57 and the carbon rod 58, and it is distributed to the respective fixed electrodes through the very small gaps. The high voltages distributed to the respective fixed electrodes are supplied to the corresponding ignition plugs, and generate sparks in the ignition plugs.

Figure 2:
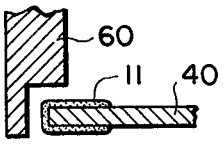
FIGS. 2 and 3 are partially-enlarged sectional views each showing a rotating electrode and a fixed electrode of the distributor shown in FIG. 1.
Figure 3:
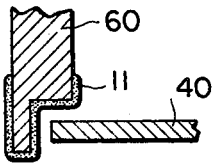

The rotating electrode 40 and one fixed electrode 60 among the fixed electrodes will be hereinbelow described in detail with reference to FIGS. 2 and 3. In FIG. 2, the discharge tip part of the rotating electrode 40 is coated with a layer 11 of an oxide of an alkaline-earth metal. On the other hand, in FIG. 3, only the tip part of the fixed electrode 60 is coated with a layer 11 of an oxide of an alkaline-earth metal. Further, although no illustration is made, both the discharge tip part of the rotating electrode 40 and the tip part of the fixed electrode 60 may be coated with the layers of the oxide of the alkaline-earth metal. From the viewpoints of easy work etc., however, it is advantageous that the discharge tip part of the rotating electrode 40 is coated with the layer 11 of the oxide of the alkaline-earth metal. The whole rotating electrode 40 or fixed electrode 60 may well be molded of the oxide of the alkaline-earth metal.

Hereunder, a few methods of manufacturing the rotating electrode will be explained.

Applied Electrode

EXAMPLE 50 parts of barium carbonate, 40 parts of strontium carbonate, 10 parts of calcium carbonate and 1.5 parts of nitrocellulose are added to butyl acetate, and they are sufficiently blended to produce a suspension. The suspension is applied to the discharge tip part of the rotating electrode 40, and is baked at about 1,000° C.

By the method described above, the rotating electrode with the alkaline-earth metal applied on its tip part can be obtained. Besides, the immersion process, the spraying process, the electrodeposition process, the fusion and extrusion process, etc. can be relied on.

Impregnated Electrode

EXAMPLE

Metal powder is compression-molded and sintered so that the porosity may become approximately 50%. The sintered compact is dipped in barium strontium acetate ($Ba.Sr(CH_3COO)_2$) at a high concentration and is subsequently immersed in water-soluble ammonium carbonate ($(NH_4)_2CO_3$) so as to settle barium strontium carbonate ($(Ba.Sr)CO_3$) in the base metal. The base metal is heated to about 1,000° C. in vacuum, with the result that a filmy layer of an oxide of barium-strontium ($(Ba.Sr)O$) is formed on the electrode surface.

Molded or Sintered Electrode

EXAMPLE 1

100 parts of powder of tungsten (W) and 30 parts of powder of barium carbonate ($BaCO_3$) are mixed. The mixture is molded and compacted under 1 ton/cm$^2$ and sintered. Thus, a filmy layer of barium oxide ($Ba_2O$) in tungsten is formed on the electrode surface.

EXAMPLE 2

Into 30 parts of barium strontium carbonate ($(Ba.Sr)CO_3$), metal powder (Mg, Cu, Fe, Mn, Si, Al, or the like) is mixed as a reductant at a weight ratio of 1. The mixture is put into powder of nickel (Ni) at a weight ratio of 20–40, and the resultant mixture is stirred in amiel acetate liquid well. After drying, the mixture is pressed and deposited onto molybdenum (Mo) or nickel (Ni) under a pressure of 5–15 ton/cm$^2$, whereupon it is heated and solidified in vacuum. As in the case of barium carbonate ($BaCO_3$) noted above, the application of heat and pressure converts the carbonate into an oxide, i.e. barium strontium oxide ($(Ba.Sr)O$).

Figure 4:
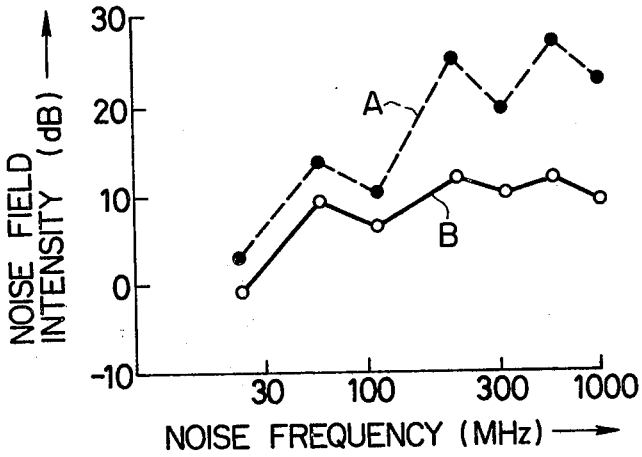
FIG. 4 is a graph showing an intensity variation versus frequencies, of noise electric waves emitted from an automobile on which the distributor according to this invention was actually installed.

In FIG. 4, the result of a measurement of noise field intensities in the case where the rotating electrode with the oxide of the alkaline-earth metal applied on its discharge portion was actually installed on an automobile is indicated by a solid line A. In the graph, the axis of ordinates represents the noise field intensity, and the axis of abscissas the frequency. On the axis of ordinates, 1 $\mu$V/m is taken as 0 dB, and the peak-to-peak value of a horizontally-polarized wave in a bandwidth of 1 kHz is indicated.

In the graph, for the sake of comparison, noise field intensities in the case where a distributor having a rotor on which a rotating electrode made of brass was mounted was actually installed on an automobile are indicated by a broken line B.

What we claim:

1. A distributor for distributing a high voltage from an ignition system of an internal combustion engine to sparking plugs, comprising: a rotary shaft which rotates in synchronism with a rotation of the internal combustion engine; a rotor which is disposed on said rotary shaft; a rotating electrode which is disposed on said rotor; a cap which is disposed in a manner to surround said rotary shaft, said rotor and said rotating electrode; means mounted on said cap and for leading the high voltage from the ignition system to said rotating electrode; and a plurality of fixed electrodes which are arranged so as to oppose to said rotating electrode through very small gaps with a rotation of said rotor and which supply the distributed high voltage to the corresponding sparking plugs; a filmy layer including at least one oxide from the group consisting of alkaline-earth metals of barium, strontium and calcium being formed on a surface of at least either of a discharge portion of said rotating electrode and said each fixed electrode.

2. A distributor for distributing a high voltage from an ignition system of an internal combustion engine to sparking plugs, comprising: a rotary shaft which rotates in synchronism with a rotation of the internal combustion engine; a rotor which is disposed on said rotary shaft; a rotating electrode which is disposed on said rotor; a cap which is disposed in a manner to surround said rotary shaft, said rotor and said rotating electrode; means mounted on said cap and for leading the high voltage from the ignition system to said rotating electrode; and a plurality of fixed electrodes which are arranged so as to oppose to said rotating electrode through very small gaps with a rotation of said rotor and which supply the distributed high voltage to the corresponding sparking plugs; a filmy layer including at least one oxide from the group consisting of alkaline-earth metals of barium, strontium and calcium being formed on a surface of a discharge portion of said rotating electrode.

3. A distributor for distributing a high voltage from an ignition system of an internal combustion engine to sparking plugs, comprising: a rotary shaft which rotates in synchronism with a rotation of the internal combustion engine; a rotor which is disposed on said rotary shaft; a rotating electrode which is disposed on said rotor; a cap which is disposed in a manner to surround said rotary shaft, said rotor and said rotating electrode; means mounted on said cap and for leading the high voltage from the ignition system to said rotating electrode; and a plurality of fixed electrodes which are arranged so as to oppose to said rotating electrode through very small gaps with a rotation of said rotor and which supply the distributed high voltage to the corresponding sparking plugs; a filmy layer including at least one oxide from the group consisting of alkaline-earth metals of barium, strontium and calcium being formed on a surface of said each fixed electrode.

* * * * *